US005088607A

United States Patent [19]

Risafi et al.

[11] Patent Number: 5,088,607

[45] Date of Patent: Feb. 18, 1992

[54] PULL-OUT TRAY ASSEMBLY FOR AN INTEGRATED MODULAR STORE FIXTURE SYSTEM

[75] Inventors: Chris Risafi, Aberdeen, N.J.; Fred Howard, New York, N.Y.

[73] Assignee: Sara Lee Corporation, Winston-Salem, N.C.

[21] Appl. No.: 492,949

[22] Filed: Mar. 12, 1990

[51] Int. Cl.[5] ..... A47F 7/00

[52] U.S. Cl. ..... 211/59.3; 211/187

[58] Field of Search ..... 211/59.2, 187, 184, 211/190, 59.3; 108/144, 111

[56] References Cited

U.S. PATENT DOCUMENTS

| | | | |
|---|---|---|---|
| 3,308,961 | 3/1964 | Chesley | 211/59.3 |
| 4,669,692 | 6/1987 | Mastrodicasa | 211/187 X |
| 4,762,235 | 8/1988 | Howard et al. | 211/59.3 |
| 4,901,869 | 2/1990 | Hawkinson et al. | 211/59.3 |

FOREIGN PATENT DOCUMENTS

| | | | |
|---|---|---|---|
| 106617 | 6/1963 | Netherlands | 211/59.3 |

*Primary Examiner*—Alvin C. Chin-Shue
*Assistant Examiner*—Sarah A. Lechok
*Attorney, Agent, or Firm*—Darby & Darby

[57] ABSTRACT

An integrated modular store fixture system having a tray assembly for displaying merchandise. The tray assembly includes a tray support having front and side panels and a slidable tray in sliding engagement with the side panels to slide between a forward and rearward position. A pusher is provided to slide along the tray to press merchandise forwardly towards the front panel. A divider for separating the tray into compartments is provided with means for gliding along the width of a channel formed in a front member disposed the front panel. The front member includes an additional channel to receive a front stop.

21 Claims, 3 Drawing Sheets

16
32
305
310
303
308
319
302
30
307
301
311
322
107
104
304
160
306
315
101
10
109
115
103
113
15
11
123
125
12
121
111
14
141
131
112
13
129
120
2

2a
2b
10
11
12
13
14
15
16
30
32
101
103
107
109
111
112
113
115
120
121
123
125
127
129
131
140
141
142
143
160
161
301
319

160
16
32
303
301
302
304
30
101
113
115
10
6
143
145
146
14
141
107
104
109
142
111
140
112
161
103
15

PULL-OUT TRAY ASSEMBLY FOR AN INTEGRATED MODULAR STORE FIXTURE SYSTEM

FIELD OF THE INVENTION

The present invention relates to a modular store fixture system capable of storing and displaying packaging in all shapes and sizes and automatically delivering such diverse packaging to the front of the tray.

BACKGROUND OF THE INVENTION

Prior store fixture systems suffer from several problems and deficiencies. These systems are not capable of storing and displaying packaging in all shapes and sizes and delivering such diverse packaging automatically to the front of the shelves. Additionally, these prior systems lack the degree of adjustability and flexibility to permit product display based on rate of sale.

The need exists for a modular store fixture system which can permit any retailer to allocate specific amounts of space to a product category based on his store's volume and profit. The need also exists for such a system where the retailer can reset the display to conform to his store's changes in volume and profit.

The need also exists for a store fixture system which maintains a neat final product presentation and makes removal and restocking of product easy and uncomplicated.

The aforementioned problems and deficiencies of the prior art are overcome by the present invention which comprises a tray assembly having at least one laterally adjustable divider to separate the tray into a number of desired compartments and of any desired size to accommodate packaging of different shapes and sizes. The present invention further includes a pusher which together with the force of gravity of the inclined tray automatically pushes the merchandise to the front of the tray assembly as the products are being removed to maintain a neat product presentation.

The present invention advantageously allows for a product display based on an individual store's rate of sale. Thus, the percentage of space and facing which the packaging will occupy can be directly proportional to the percentage of the store's sales. Additionally, should the sales percentages change at any time in the future the display can be reset to conform to the new sales figures, thereby allowing a retailer to allocate specific amounts of space to a product category based on his store's new volume and profit. The display of the present invention not only permits highly efficient space usages but provides the inherent ability of neatly organizing the product category for greatest visual effect.

BRIEF DESCRIPTION OF THE DRAWINGS

The objects, features, and advantages of the present invention will be more completely disclosed with reference to the following detailed description of presently preferred embodiment of the present invention, taken with the attached drawings, in which:

FIG. 1*a* is a fragmentary sectional view of the tray assembly taken along lines 2*a*—2*a* of FIG. 2 and looking in the direction of the arrows;

DETAILED DESCRIPTION OF THE PREFERRED EMBODIMENT

Figures 1, 3:
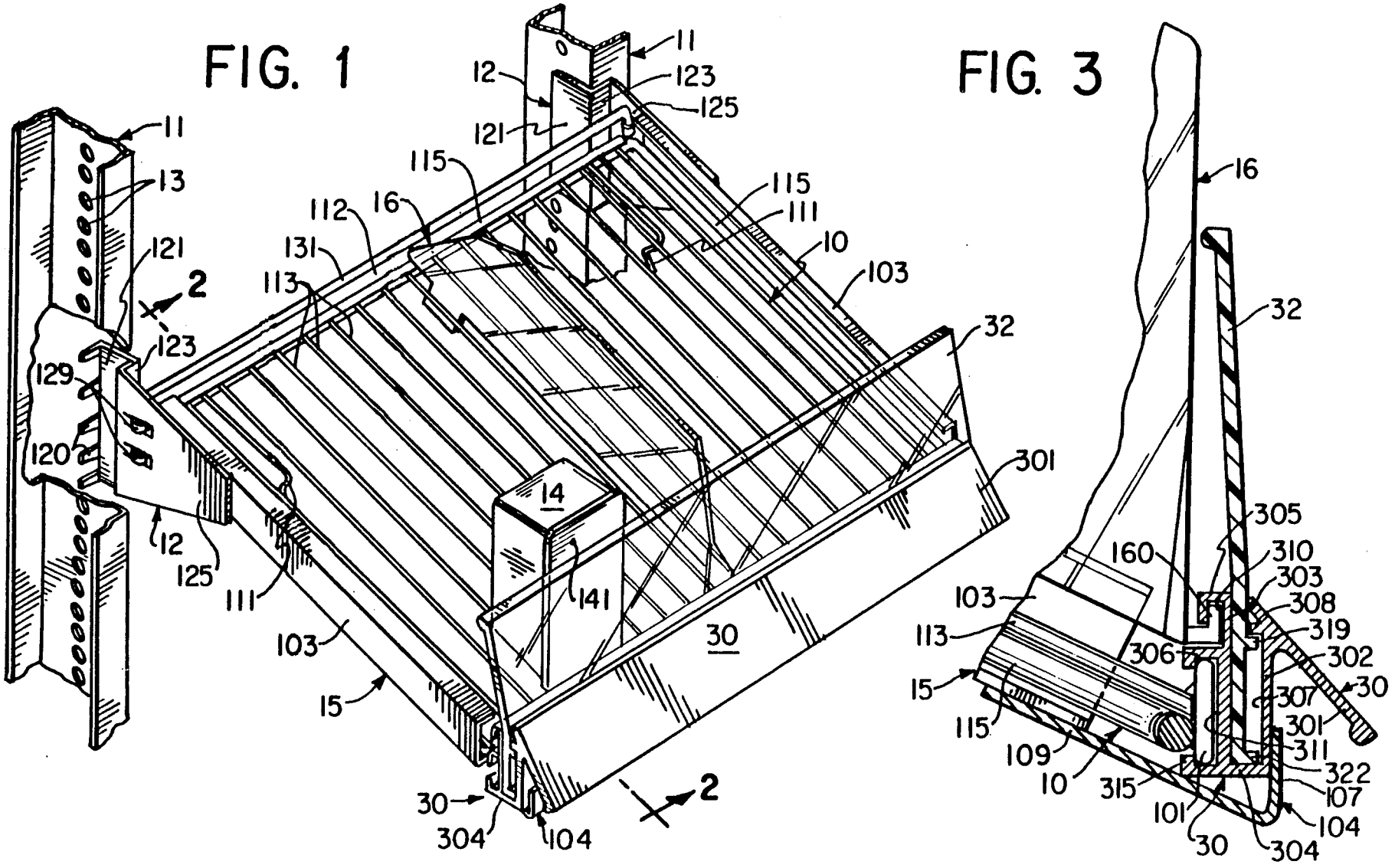
FIG. 1 is a perspective view of the tray assembly of the present invention shown mounted in a supporting frame with the tray in its normal retracted position.
FIG. 3 is an enlarged fragmentary view of the right-hand portion of FIG. 2 to show the details of the front portion of the tray assembly.

Referring now to the drawings, wherein like reference numerals represent identical or corresponding parts throughout the several views, FIG. 1 illustrates a tray assembly embodying the present invention, which is designed for use with a store fixture system such, as that disclosed in U.S. Pat. Nos. 4,726,235; 4,765,492; and 4,771,898. The tray assembly comprises a tray 10, a tray support 15, a pusher 14, a divider 16 and a front attachment 30, all of which are discussed in detail below.

Tray support 15 is secured to spines 11 by a bracket 12. Spines 11, preferably tubular and of rectangular cross section, are disposed in a vertical position on opposing sides of tray support 15 and are designed to hold tray support 15 in an outward position. Spines 11 are typically part of a frame structure used to support an entire display system including one or more tray assemblies. A plurality of openings 13 are formed through the side wall of each spine 11, along its entire length, to receive a bracket 12. An example of a spine 11 which could be utilized with the present invention is disclosed in more detail in U.S. Pat. No. 4,762,235.

Brackets 12 are provided to support both the left and right sides of tray support 11 by rigid securement to the side walls of spines 11. Each bracket 12 includes perpendicular walls 121 and 123 in its rear portion and an outer wall 125 in its front portion. When secured, walls 121 and 123 are flush with the side and front walls of spine 11, respectively, and the inner surface of outer wall 125 of bracket 12 abuts the side of tray support 15. A plurality of integral projections 120, extending laterally outwardly from the edge of wall 121, are fitted within the openings 13 of spine 11 to provide a rigid connection. Since spine 11 has a plurality of openings 13 in vertical alignment along its entire length, the vertical height of tray support 15 can be adjusted by inserting projections 120 of bracket 12 in any contiguous group of these openings. Although five projections 120 are shown on each bracket in the drawings, obviously, more or fewer projections could be utilized. Slots 127 are formed in outer wall 125 through which a lance 129 protrudes to receive a spacer rod 131 (see also FIG. 2).

Turning now to the tray support 15 of the present invention, and with continued reference to FIG. 1, tray support 15 includes left and right side panels 103 and a front panel 104 disposed perpendicular to side panels 103. Side panels 103 are C-shaped with parallel top and bottom walls to form a side channel to receive tray 10. Front panel 104 has a front wall 107 and a bottom wall 109 which form an acute angle. (See FIG. 3) Tray 10, which is designed to hold the merchandise, is formed by a plurality of parallel spaced apart rods disposed on a frame. More particularly, the frame comprises a front vertical panel 101 (see FIG. 2), upper and lower transverse rods 112 formed into a rectangular frame rod 115, and a plurality of equidistantly spaced parallel longitudinal rods 113 extending from the front to the rear of tray 10 below upper transverse rods 112 so that rods 113 are substantially parallel with side supports 103. Rods 113 form a bottom support for the merchandise. Rods 112, 113 and 115 are preferably of circular cross-section, with rods 112 and 115 having a larger diameter than rods 113. Lateral rods 101 and 115 are each slidably received within one of the side channels formed in the left and right side panels 103, to allow for tray 10 to be slid forward (extended outwardly) and rearward (retracted inwardly), thus facilitating access to tray 10. This is discussed in detail below.

Figures 2, 2A, 2B:
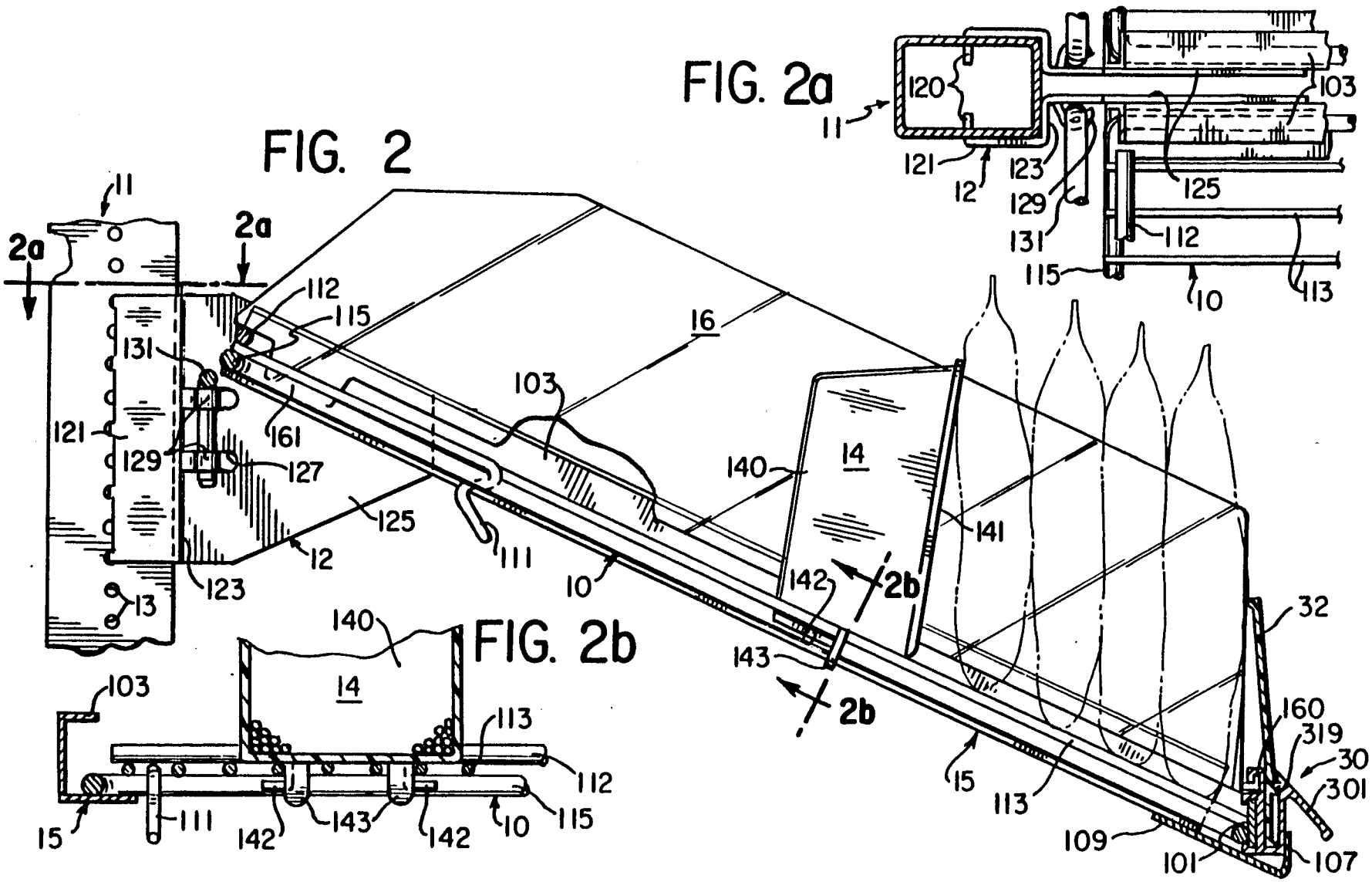
FIG. 2 is a sectional, enlarged view taken along line 2—2 of FIG. 1 and looking in the direction of the arrows, the tray of the tray assembly being shown in the retracted display position, with merchandise loaded in the tray and shown in dashed lines.
FIG. 2*b* is a fragmentary sectional view of the tray assembly taken along lines 2*b*—2*b* of FIG. 2 and looking in the direction of the arrows.
Figures 4, 5, 6:
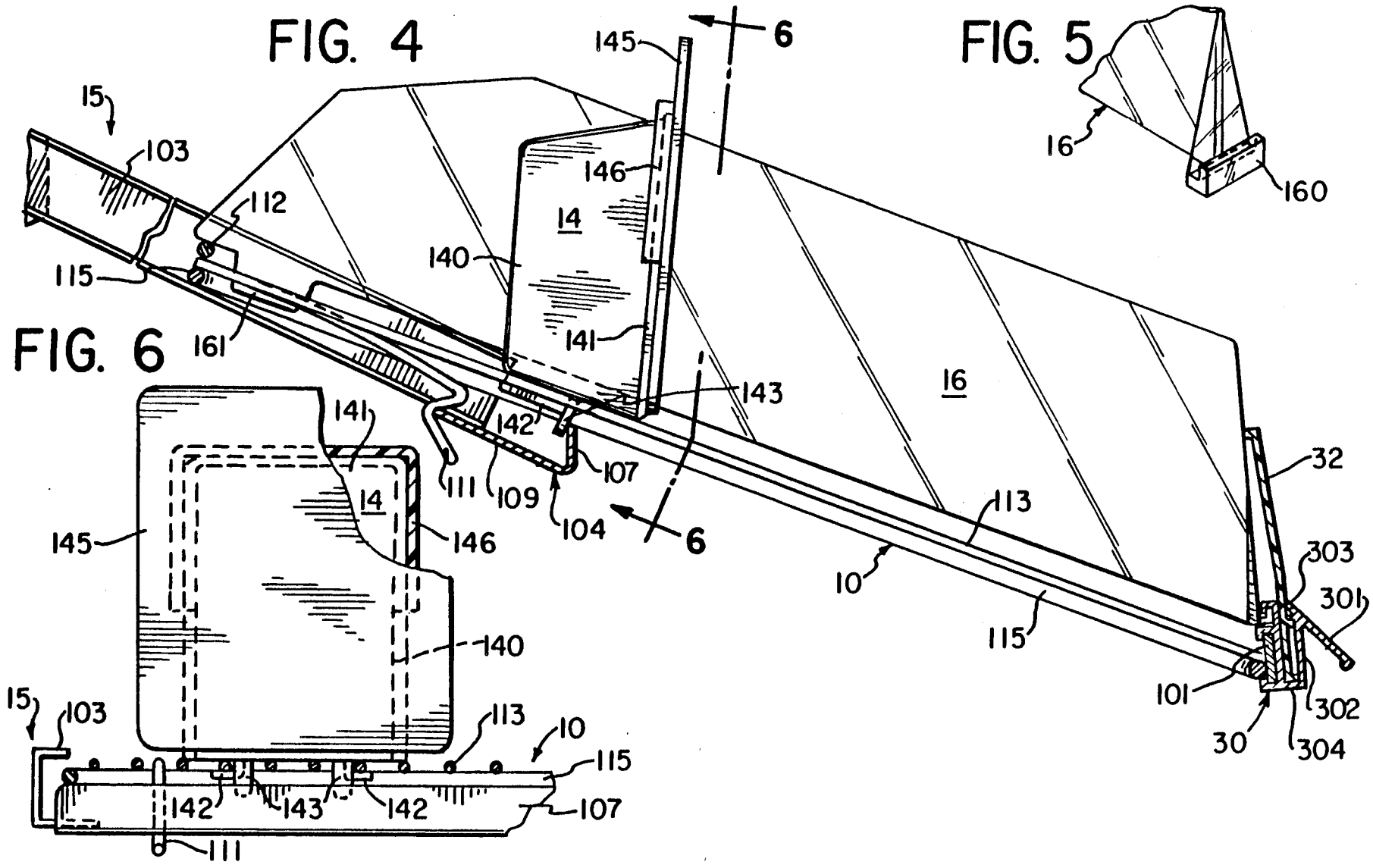
FIG. 4 is a sectional view showing the tray of the tray assembly in its extended loading position.
FIG. 5 is a fragmentary perspective view showing details of the front, of the divider of the tray assembly.
FIG. 6 is a fragmentary sectional view of the tray assembly taken along line 6—6 of FIG. 4 and looking in the direction of the arrows.

A resilient hook 111 is disposed between two adjacent longitudinal rods 113 on either side of tray 10, as shown in FIGS. 1, 2 and 4. Similar to longitudinal rods 113, hook 111 is secured between upper transverse rod 112 and lateral rod 115. As seen in the figures, hook 111 has an inverted S-shape, with its bottom end extending below the lower plane of longitudinal rods 113 of tray 10. The function of hook 111 is described below.

A front member or attachment 30, preferably composed of aluminum, is provided in front of tray support 15. As shown in FIG. 3, front attachment 30 comprises an angled wall 301, a front vertical wall 302, a rear vertical wall 303 and a bottom horizontal wall 304 joining front and rear vertical walls 302 and 303. Angled wall 301 terminates above bottom wall 304. A rearwardly extending protrusion or flange 308 is formed in the upper portion of front vertical wall 302, parallel to bottom wall 304 to form a groove 307 therebetween. Rear vertical wall 303 has top and bottom L-shaped extensions 305 and 306 which form channels 310, 311, respectively. That is, channel 310 is formed between top extension 305 and bottom extension 306 to receive a longitudinal partition or divider 16 (discussed below) and channel 311 is formed between bottom extension 306 and a flange 315 of bottom wall 304 to receive vertical front panel 101 of tray 10. The top and bottom extensions 305, 306 and flange 315 of bottom wall 304 thereby cooperate to restrict vertical and longitudinal movement of divider 16 and front panel 101.

An upright panel 32, preferably comprised of a clear plastic material, so that the merchandise in tray 10 can be seen, fits within groove 307 formed by front vertical wall 302 and rear vertical wall 303. A middle lip or projection 319 of panel 32, extending in an opposite direction to protrusion 308 of front vertical wall 302, underlies protrusion 308 and is captured therebelow to prevent vertical movement of panel 32. Bottom lip 322 of panel 32 extending forwardly, rests on bottom wall 304 of front attachment 30. The top of angled wall 301 presses against the front of panel 32 to stabilize it against forward and rearward movement.

The retaining slide of pusher 14 of the present invention is used to push merchandise toward the front of tray 10, to facilitate access to the merchandise, as well as to improve the appearance of the display by keeping the merchandise neatly in place. As shown in FIGS. 2 and 4, pusher 14 comprises a body 140 having a peripheral flange 141. The pusher 14 is made of plastic or other suitable material, and its body 140 is hollow, but is filled with a heavy material such as sand or suitable weights. A shield 145 having an inwardly directed inverted V-shaped channel 146 can be slid over flange 141 (See FIG. 4) and flange 141 is then received in this channel. Shield 145 has a greater surface area than body 140, to advantageously increase the surface area contact between pusher 14 and the merchandise. This is particularly advantageous for larger merchandise since it restrains the merchandise from falling rearwardly which would detract from the appearance of the display. Pusher 14 has two discrete spaced apart L-shaped projections or tabs 142 which extend downwardly from its lower surface and laterally towards its side walls. Each L-shaped projection 142 forms a channel to slidably receive one of the longitudinal rods 113 of tray 10, to allow the pusher 14 to slide forward on tray 10 as merchandise is removed. Two spaced apart, depending stops or tabs 143 extend below projections 142, to prevent forward movement of pusher 14, as will be described in detail below.

A divider 16, preferably made of clear plastic, is provided to separate the tray 10 into side-by-side compartments as shown in FIG. 1. Although only one divider is shown in the drawings, several dividers can be utilized to separate tray 10 into additional compartments. The divider is placed between any two adjacent rods 113 so that it is supported by rod 112 and a depending rear projection 161 extends between the adjacent rods 113, to restrict lateral movement of the divider and to help maintain it in an upright position. The front portion of the divider, shown in FIGS. 2, 3 and 5, has a hook-shaped link 160 which fits within channel 310 formed between L-shaped extensions 305 and 306 of rear vertical wall 303 of front attachment 30 (See FIG. 3). This allows divider 16 to be slid laterally along the length of channel 310, to allow easy adjustment of the size of the compartment to any desired width. To change the size of the compartment, the rear projection 161 of divider 16 is lifted above rods 113 and link 160 is slid along the length of channel 310 to the desired location. L-shaped extension 305 of rear vertical wall 303 limits undesired upward movement of the divider 16, which would remove it from the channel 310.

In use, to load the merchandise, tray 10 is lifted so that front attachment 30 is raised above front wall 107 and tray 10 will slide forward by force of gravity, thereby gliding along side channels formed in side panels 103 to an extended or loading position shown in FIG. 4. The tray slides forwardly until resilient hook 111 is captured by bottom wall 109 of front panel 104 (See FIG. 4). The forward movement of pusher 14 is halted when tab 143 contacts front wall 107 while the tray continues to slide forward. Thus, pusher 14 is advantageously prevented from interfering with the merchandise during loading. After loading, tray 10 is pushed rearwardly to glide within the channels formed inside panels 103, bringing the slider into retaining contact with the rearmost items of merchandise (See FIG. 2). As tray 10 reaches its fully retracted position, front attachment 30 is raised above front wall 107, to return to the display position depicted in FIG. 2. Front wall 107 then functions to prevent forward movement of tray 10. As merchandise is removed from tray 10 when it is in the display position, pusher 14 glides along rods 113 to push the merchandise forward to the front of tray 10. Thus, the pusher 14 maintains neatness of the product presentation.

The assembly of the present invention advantageously permits product display based on an individual's store rate of sale. For example, Brand X presented in a cube-shaped box, responsible for 60% of sales, can be allocated 60% of space and facings; Brand Y presented in a flat envelope package, responsible for 15% of sales, can be allocated 15% of space and facings, and Brand Z presented in Pouch Packs, responsible for 25% of sales, can be allocated 25% of sales and facing. Due to the high degree of flexibility and adjustability of the assembly of the present invention, should sales percentages change at any time in the future, the display can be reset to conform to the new sales fixtures.

It will be appreciated that the instant specification and claims are set forth by way of illustration and not limitation, and that various modifications, additions or substitutions may be made without departing from the spirit and scope of the present invention.

What is claimed is:

1. A tray assembly for displaying merchandise in a store fixture system comprising:

a tray support having a front panel and let and right side panels, said front panel having a front wall and a bottom wall;

a slidable tray having a plurality of rods extending towards said front panel, said tray being in slidable engagement with said side panels for sliding movement between forward and rearward positions;

pusher means for pressing merchandise placed on said rods forwardly towards said front panel, said pusher means having a lower surface;

means for mounting said pusher means to effect slidable movement along at least one of said rods; and means for restricting forward movement of said pusher means when said tray is in said forward position, said restricting means comprising a first tab depending from said lower surface of said pusher means for abutting said front wall of said front panel as said tray reaches said forward position so as to prevent further forward movement of said pusher means.

2. A tray assembly as recited in claim 1, wherein said mounting means comprises first and second projections depending downwardly from said lower surface of said pusher, each of said projections forming a channel to slidably receive one of said rods.

3. A tray assembly as recited in claim 2, wherein said projections are L-shaped.

4. A tray assembly as recited in claim 2, wherein said restricting means further comprises a second tab, said first and second tabs each extending downwardly from said lower surface of said pusher and being disposed forwardly of said first and second projections.

5. A tray assembly as recited in claim 4, wherein said projections are discrete and are integral with said pusher.

6. A tray assembly for displaying merchandise in a store fixture system comprising:

a tray support having a front panel and left and right side panels, said front panel having a front wall and a bottom wall;

a slidable tray having a plurality of rods extending towards said front panel, said tray being in slidable engagement with said side panels for sliding between forward and rearward positions;

pusher means for pressing merchandise placed on said rods forwardly towards said front panel, said pusher means having a lower surface;

means for mounting said pusher means to effect slidable movement along at least one of said rods; and restricting means for restricting forward movement of said pusher means as said tray reaches said forward position, said restricting means comprising a tab depending from said lower surface of said pusher means and which abuts said front wall of said front panel when said tray is in said forward position, said pusher means having a front portion which comprises a flange and a shield which is disposed on said flange, said shield having a face with an area greater than an area of a face of said pusher means so as to provide a larger contact surface with the merchandise than would be provided otherwise by said face of said pusher means.

7. A tray assembly as recited in claim 1, further comprising a resilient hook, said hook extending below said rods in a position to engage said bottom wall of said front panel when said tray is in said forward position, to restrict further forward movement of said tray.

8. A tray assembly as recited in claim 7, wherein said restricting means further comprises a second tab extending downwardly from said lower surface of said pusher to abut said front wall of said panel when said tray is in said forward position.

9. A tray assembly as recited in claim 7, further comprising a second resilient hook extending below said rods to engage said bottom wall of said front panel when said tray is in said forward position.

10. A tray assembly as recited in claim 1, wherein said tray support is secured to a spine by a bracket, said bracket having a plurality of projections and said spine having a plurality of openings to receive said projection.

11. A tray assembly for displaying merchandise in a store fixture system comprising:

a tray having a front panel and a bottom support for the merchandise;

divider means for separating said tray into separate side-by-side compartments, said divider means being detachably mounted for effecting slidable movement along a rear of said front panel in an orientation so as to be generally perpendicular thereto, thereby adjusting the lateral dimension of said compartments, said divider means having a hook-shaped forward extension, said front panel having a channel formed in a rear thereof that is dimensioned for receiving said extension, said extension and said channel cooperating with each other for mounting said divider means so as to enable said slidable movement to take place, said bottom support including a plurality of generally parallel rods in a front-to-rear orientation; and p1 restriction means for restricting lateral movement of said divider means, said restriction means comprising a depending rear extension that is disposed between adjacent rods and extends below said rods from said divider means into position so as to restrict lateral movement of said divider means.

12. A tray assembly for displaying merchandise in an integrated modular store fixture system comprising:

a tray support having a front panel and side panels;

a slidable tray having a plurality of rods extending towards said front panel;

means for slidably holding said tray to said support so that said tray is slidable between retracted and extended positions with respect to said support;

a front member disposed on said front panel of said tray, said front member having a forwardly and downwardly angled wall, a first vertical wall behind said angled wall, a second vertical wall spaced rearwardly from said first vertical wall, and a bottom wall joining said first and second vertical walls to define a first channel therebetween;

a display panel disposed substantially vertically in said first channel and having a lip, said angled wall extending upwardly and rearwardly to press against said display panel; and engaging means for engaging and retaining said lip, said engaging means including a protrusion extending rearwardly from said first vertical wall to engage and retain said lip.

13. A tray assembly as recited in claim 12, wherein said display panel comprises a forward projection extending opposite to said protrusion of said first vertical wall, said projection lying underneath said protrusion in position to restrict vertical movement of said display panel.

14. A tray assembly as recited in claim 13, wherein said second vertical wall comprises first and second L-shaped extensions directed rearwardly and downwardly towards said bottom wall.

15. A tray assembly as recited in claim 14, wherein a second channel is formed between said second flange and said bottom wall, said second channel being adapted to receive a front piece of said tray.

16. A tray assembly as recited in claim 12, wherein said front member is an aluminum extrusion and said front panel is made of a transparent material.

17. A tray assembly for displaying merchandise in a store fixture system including a support structure, comprising:

a tray slidably mounted in said fixture system for effecting slidable movement relative to said support structure between a retracted rearward position and an extended forward position, said tray including means defining a bottom support for the merchandise, said tray being mounted so as to have a forward and downward incline;

pusher means slidably mounted on said bottom support for effecting forward and rearward slidable movement in a position to contact the merchandise; and means for restraining said pusher means against forward slidable movement as the tray is moved from said retracted position to said extended position.

18. A tray assembly in accordance with claim 17 wherein said restricting means comprises:

a contact member depending from said pusher means; and means defining a stopping surface fixed in position relative to said support structure, said stopping surface being positioned to engage and capture said contact member, to prevent its forward movement.

19. A tray assembly for displaying merchandise in a store fixture system including a support structure, comprising:

a tray mounted in said fixture system for effecting slidable movement relative to said support structure between an extended forward position and a retracted rearward position, said tray including means defining a bottom support for the merchandise, said tray being mounted so as to have a forward and downward incline;

pusher means mounted on said bottom support for effecting forward and rearward slidable movement to reach a position for contacting the merchandise; and means for restraining said pusher means against forward sliding movement as the tray is moved from said retracted position to said extending position, said pusher means comprising a main body and a planar shield member detachably mounted to said main body so as to be forward thereof, said shield having a substantially greater area than said main body when viewed from the front.

20. A tray assembly for displaying merchandise in a store fixture system including a support structure, comprising:

a tray mounted in said fixture system for effecting slidable movement relative to said support structure between an extended forward position and a retracted rearward position, said tray including means defining a bottom support for the merchandise, said tray being mounted so as to have a forward and downward incline;

pusher means mounted on said bottom support for effecting forward and rearward slidable movement to reach a position for contacting the merchandise; and means for restraining said pusher means against forward sliding movement as the tray is moved from said retracted position to said extended position, said shield being mounted on said pusher means by means of a groove on one of said pusher means and said shield and a complementary flange on the other of said pusher means and said shield.

21. A tray assembly in accordance with claim 18 further comprising a front panel on said tray and a divider member mounted for sliding movement to the rear of said front panel in an orientation so as to be generally perpendicular to said front panel, whereby said tray is formed into side-by-side compartments of selectable lateral extent.

* * * * *